US006435112B1

(12) United States Patent
Insalaco

(10) Patent No.: US 6,435,112 B1
(45) Date of Patent: Aug. 20, 2002

(54) HEIGHT ADJUSTABLE TABLE

(75) Inventor: Robert Warren Insalaco, Holland, MI (US)

(73) Assignee: Herman Miller, Inc., Zerland, MI (US)

( * ) Notice: Subject to any disclaimer, the term of this patent is extended or adjusted under 35 U.S.C. 154(b) by 0 days.

(21) Appl. No.: 09/583,220

(22) Filed: Jun. 2, 2000

Related U.S. Application Data

(60) Provisional application No. 60/137,630, filed on Jun. 4, 1999.

(51) Int. Cl.[7] ..... A47B 9/00

(52) U.S. Cl. ..... 108/147.21; 248/161; 248/407

(58) Field of Search ..... 108/147.21, 147, 108/144.11; 248/161, 407, 408, 412, 157

(56) References Cited

U.S. PATENT DOCUMENTS

| | | | | | |
|---|---|---|---|---|---|
| 373,376 | A | | 11/1887 | Penfield | |
| 1,048,143 | A | | 12/1912 | Franke | |
| 2,302,237 | A | * | 11/1942 | McFall | 248/161 |
| 2,388,056 | A | * | 10/1945 | Hendricks | 248/407 |
| 2,947,556 | A | * | 8/1960 | Wenger | 248/161 |
| 2,961,260 | A | * | 11/1960 | Newlin | 248/161 |
| 3,741,514 | A | * | 6/1973 | Snurr | 108/144.11 X |
| 3,885,764 | A | | 5/1975 | Pebreza | |
| 4,044,979 | A | * | 8/1977 | Lemmo | 248/407 X |
| 4,076,201 | A | | 2/1978 | Hudnall | |
| 4,078,778 | A | | 3/1978 | Hubweber | |
| 4,105,195 | A | | 8/1978 | Lamberts | |
| 4,183,689 | A | * | 1/1980 | Wirges et al. | 108/144.11 X |
| 4,309,026 | A | | 1/1982 | Reuschenbach et al. | |
| 4,601,246 | A | | 7/1986 | Damico | |
| 5,393,125 | A | | 2/1995 | Watson et al. | |
| 5,397,111 | A | | 3/1995 | Knopp et al. | |
| 5,435,529 | A | | 7/1995 | Day et al. | |
| 5,513,825 | A | * | 5/1996 | Gutgsell | 108/147 X |
| 5,549,264 | A | | 8/1996 | West | |
| 5,894,805 | A | | 4/1999 | Raasch et al. | |

* cited by examiner

*Primary Examiner*—Jose V. Chen
(74) *Attorney, Agent, or Firm*—Brinks Hofer Gilson & Lione

(57) ABSTRACT

A height adjustable table that has a base and a table top. A support is attached to the tabletop where the support selectively engages the base solely via friction so that the tabletop is prevented from moving relative to the base.

32 Claims, 15 Drawing Sheets

HEIGHT ADJUSTABLE TABLE

Applicants claim, under 35 U.S.C. § 119(e), the benefit of priority of the filing date of Jun. 4, 1999, of a U.S. Provisional Patent Application No. 60/137,630 filed on the aforementioned date having the title "Height Adjustable Table" listing Richard M. Holbrook and Robert W. Insalaco as inventors, the entire contents of which are incorporated herein by reference.

BACKGROUND OF THE INVENTION

The present invention relates to the field of office furniture and workspace systems. More particularly, the invention relates to a height adjustable table.

In general, a table provides a location for people to work at while either standing or sitting on a chair. Since people and chairs come in a variety of sizes, it is often necessary to adjust the height of the table so as to improve access to the table. Height adjustable tables, such as tables with a central shaft inserted into a gas spring cylinder, are known in the art. Such height adjustable tables often use complicated and expensive mechanisms to adjust the height of the table.

Another disadvantage of some prior height adjustable tables is that they would use locking mechanisms that were external to the supports of the table and so the table was less aesthetically pleasing and the locking mechanisms could be easily damaged.

SUMMARY OF THE INVENTION

One aspect of the present invention regards a height adjustable table that has a base and a tabletop. A support is attached to the tabletop where the support selectively engages the base solely via friction so that the tabletop is prevented from moving relative to the base.

A second aspect of the present invention regards a method of locking a height adjustable table by positioning a tabletop of a height adjustable table to a desired height relative to a surface supporting a base of the table and locking the tabletop at the desired height by only frictionally engaging the tabletop to the base.

A third aspect of the present invention regards a height adjustable table that has a base and a tabletop. A support is attached to the tabletop. The support selectively engages the base via an unattached locking element so that the tabletop is prevented from moving relative to the base.

A fourth aspect of the present invention regards a method of locking a height adjustable table by positioning a table top of a height adjustable table to a desired height relative to a surface supporting a base of the table and locking the table top at the desired height by trapping a locking element so as to engage the table top and the base simultaneously.

Each of the above aspects of the present invention provides the advantage of providing a height adjustable table that is uncomplicated in operation and structure and inexpensive to build.

Each of the above aspects of the present invention provides the advantages of an aesthetically pleasing table and preventing the locking mechanisms from being easily damaged.

The present invention, together with attendant objects and advantages, will be best understood with reference to the detailed description below in connection with the attached drawings.

DETAILED DESCRIPTION OF THE PREFERRED EMBODIMENTS

Figure 2:
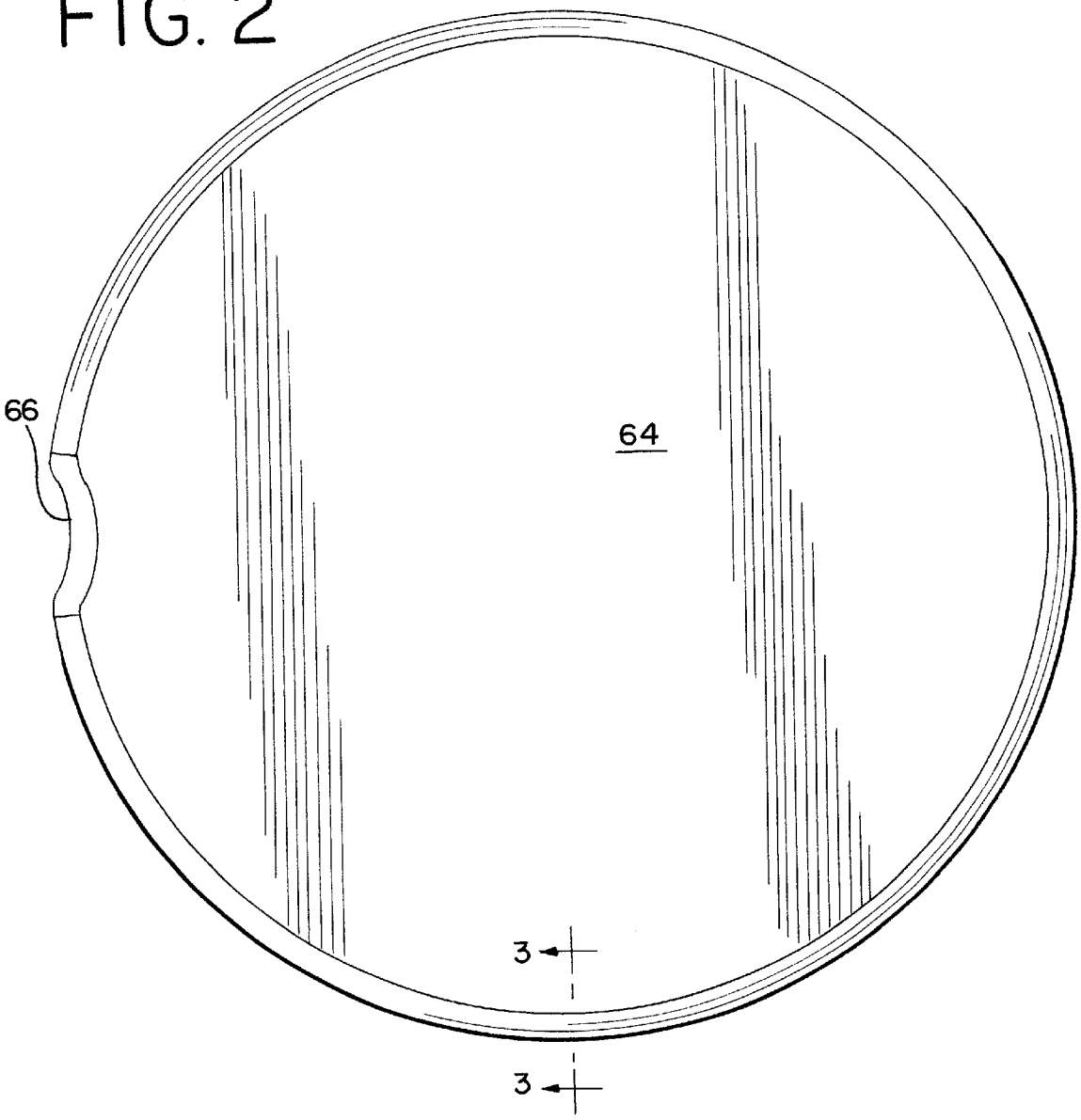
FIG. 2 is a top view of the height adjustable table of FIG. 1.
Figure 3:
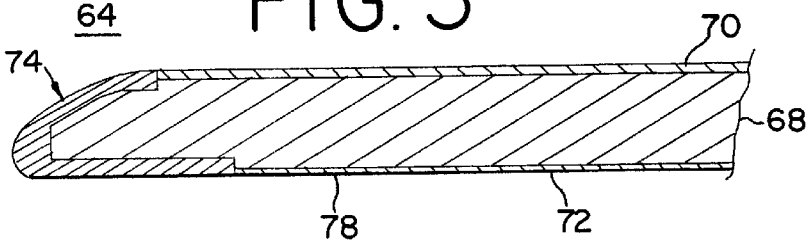
FIG. 3 is a cross-sectional view of a side of a tabletop of the height adjustable table of FIG. 1.

Referring to the drawings, FIGS. 1–16 show an embodiment of a height adjustable table 60 that has a base 62 attached to a tabletop 64. The tabletop 64 is substantially round in shape having a diameter of approximately 40 inches and a thickness of approximately 0.725 inches. As shown in FIG. 2, a curved indent 66 is formed having a length of approximately 4.2 inches and a radius of curvature of approximately 4.0 inches. The indent acts as a visual indicator in that it alerts the user of the table that the actuator levers of the braking mechanisms are located below the tabletop 64 near the indent. As shown in FIG. 3, the core 68 of the tabletop 64 is made of a durable material such as wood fiberboard. A top sheet 70 and a bottom sheet 72 of laminate are attached to the top and bottom surfaces of the core 68 in a well-known manner, such as gluing. At the edge of the core 68, a flexible material 74, such as polyurethane is attached to the core 68.

A bracket 76 is attached to the bottom surface 78 of the tabletop 64 by inserting screws (not shown) through openings 80 formed in the bracket 76.

Figure 4:
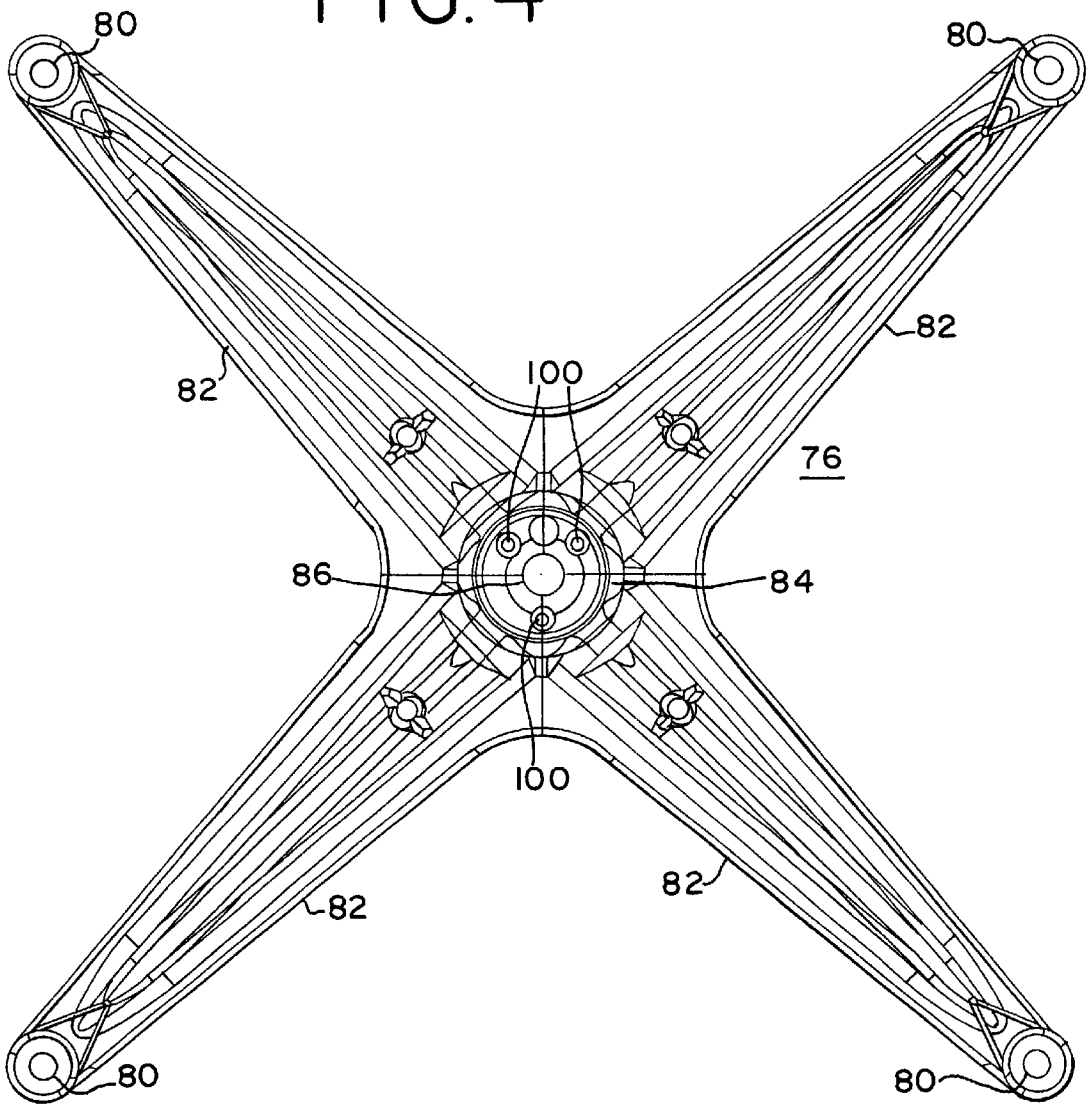
FIG. 4 is a top view of a bracket for the height adjustable table of FIG. 1.
Figure 5:
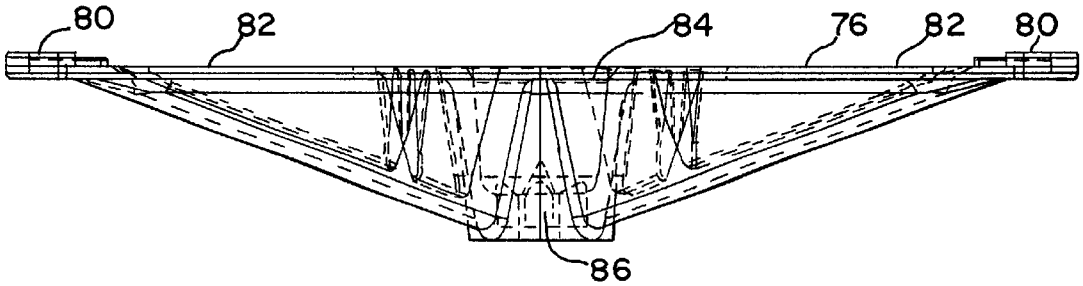
FIG. 5 is a side view of the bracket of FIG. 4.
Figure 6:
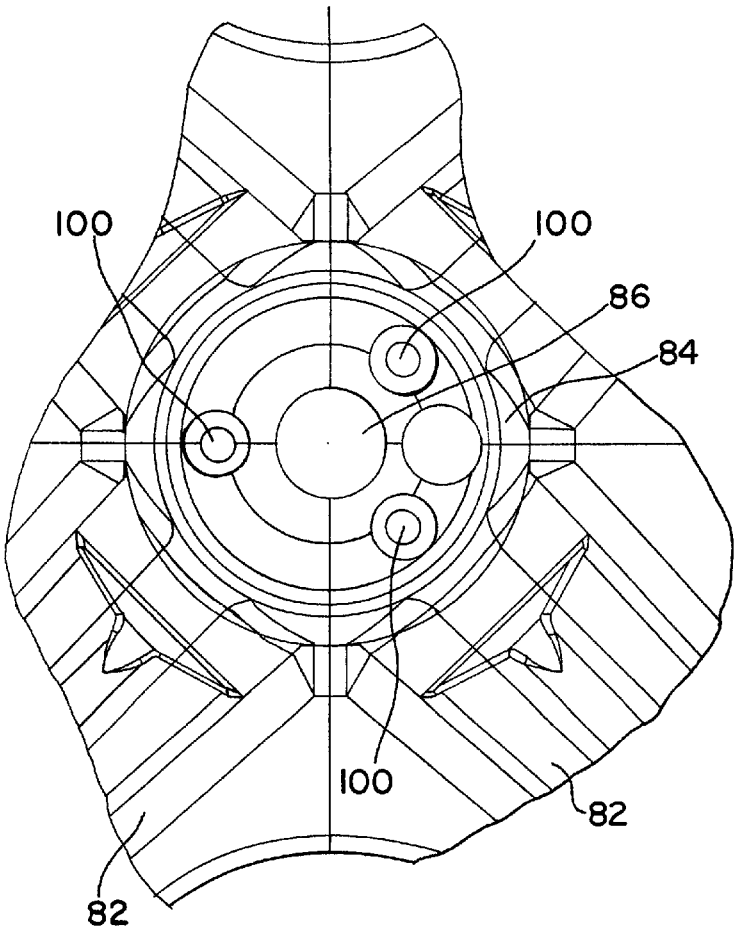
FIG. 6 is an enlarged view of the circled area of FIG. 4.

The bracket 76 is made of a durable material such as aluminum. As shown in FIGS. 4 and 5, the bracket 76 is composed of four support arms 82 that are integrally attached to a central connector 84. The arms 82 are identical in shape having a length of approximately 9.9 inches and a width of approximately 14 inches. The arms 82 are preferably at right angles relative to each other, though other angular separations are possible. The central connector 84 has a center opening 86 that is centered about the center of the bottom surface 78.

Figure 8A:
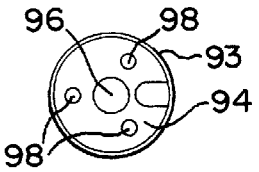
FIG. 8A is a top view of a bracket and support to be used with the height adjustable table of FIG. 1.
Figure 8C:
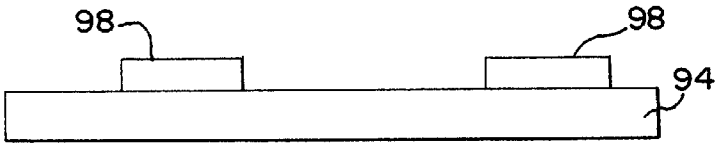
FIG. 8C is a side view of the, bracket of FIGS. 8A–B.
Figure 8B:
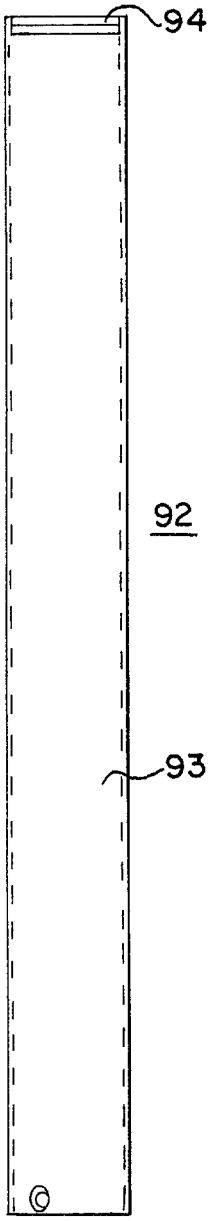
FIG. 8B is a side view of the bracket and support of FIG. 8A.
Figure 9:
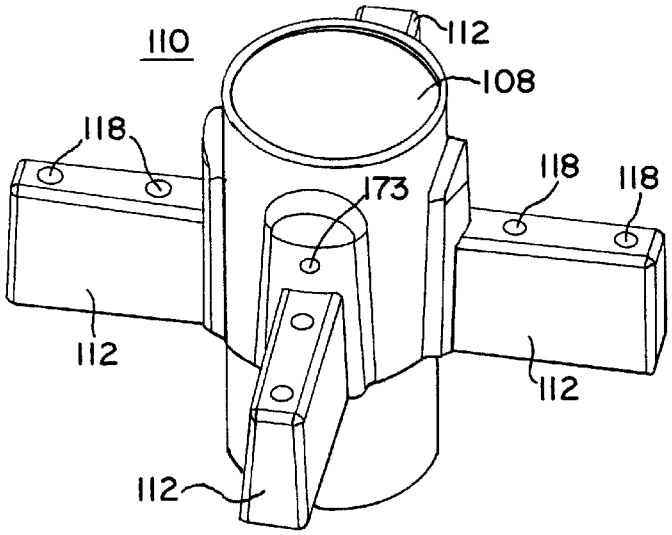
FIG. 9 is a top perspective view of a hub for the height adjustable table of FIG. 1.
Figure 10:
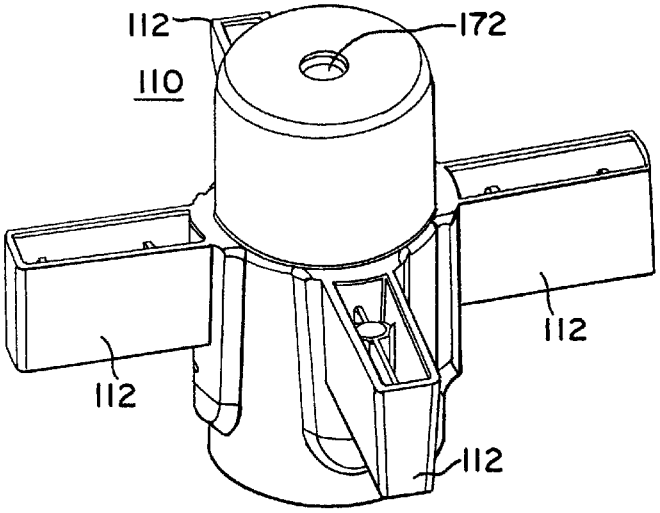
FIG. 10 is a bottom perspective view of the hub of FIG. 9.
Figure 11:
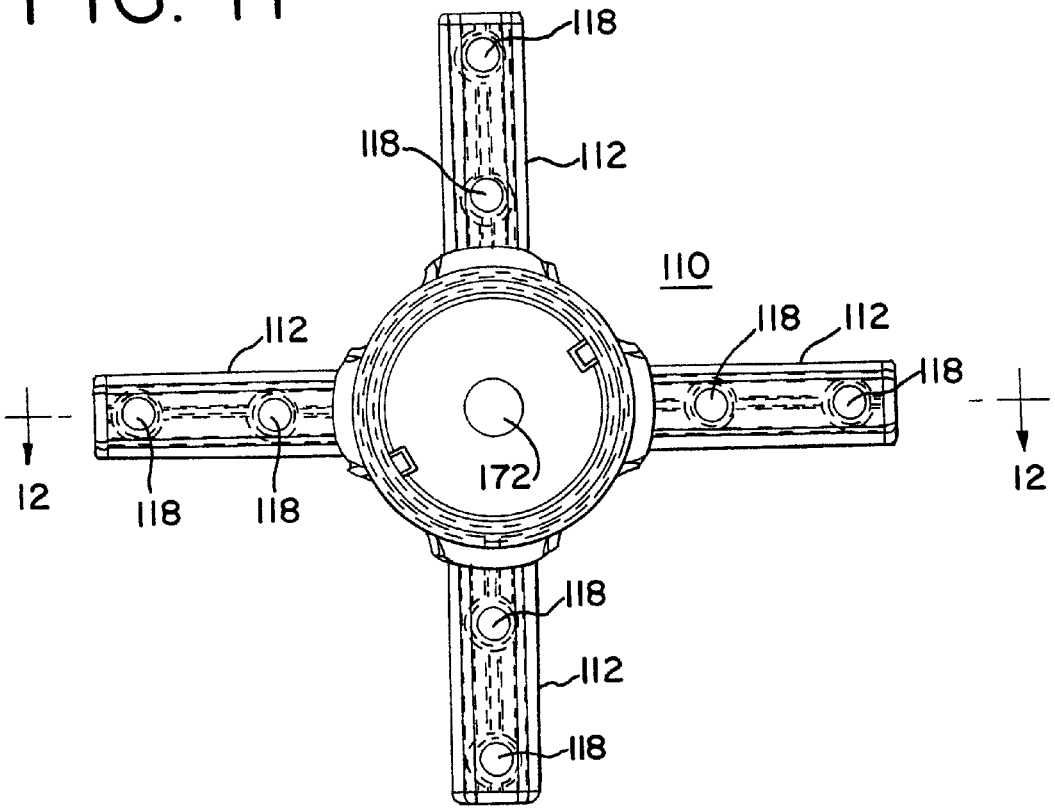
FIG. 11 is a bottom view of the hub of FIG. 9.
Figure 12:
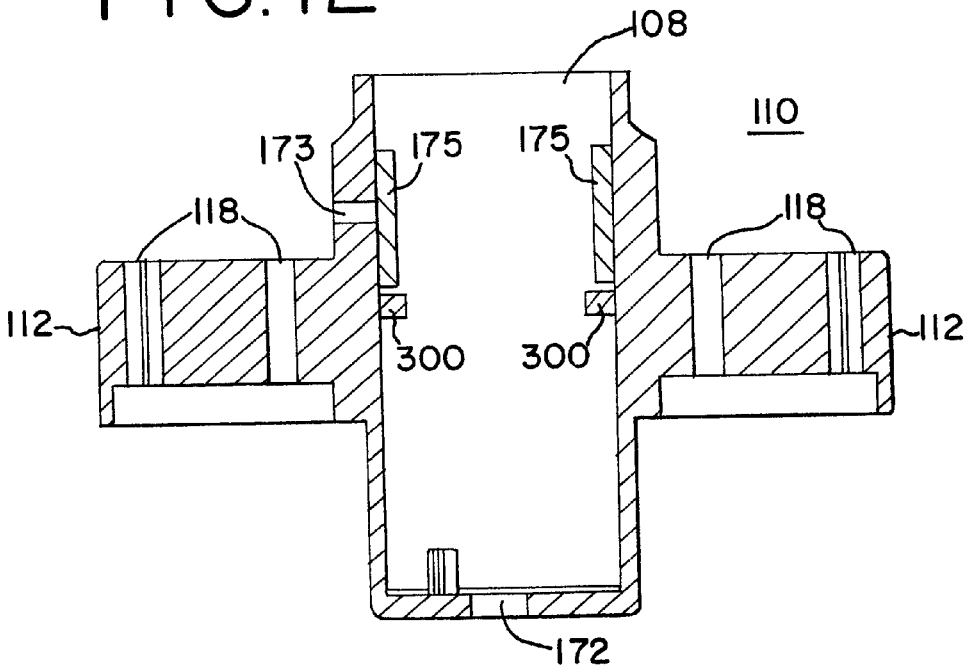
FIG. 12 is a cross-sectional view of the hub of FIG. 9 taken along lines 12—12 of FIG. 11.
Figure 13:
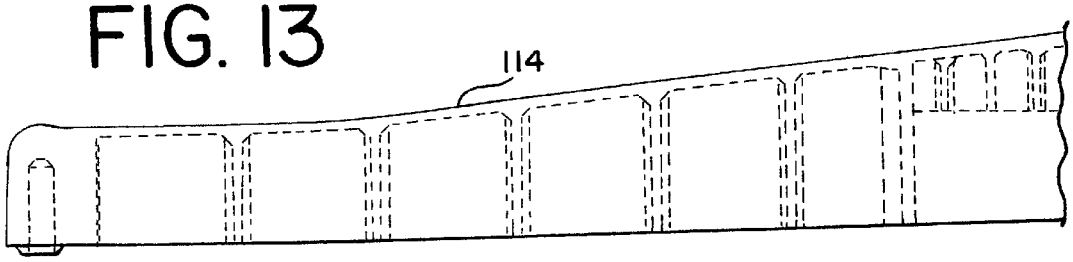
FIG. 13 shows a side view of a leg to be used with the height adjustable table of FIG. 1.
Figure 14:
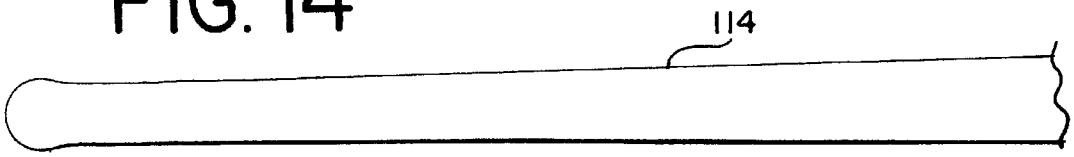
FIG. 14 shows a top view of the leg of FIG. 13.
Figure 15:
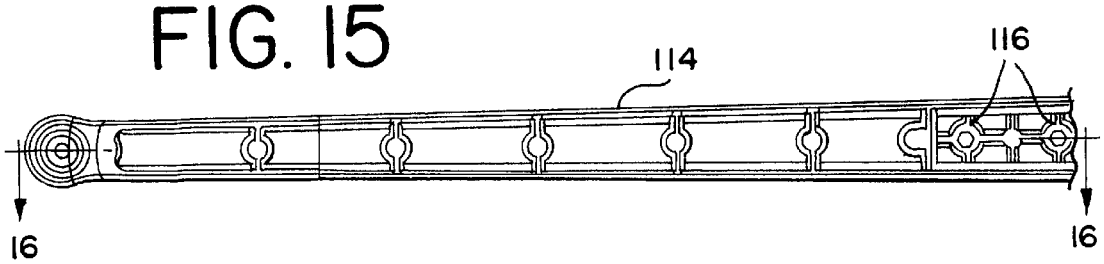
FIG. 15 shows a bottom view of the leg of FIG. 13.
Figure 16:
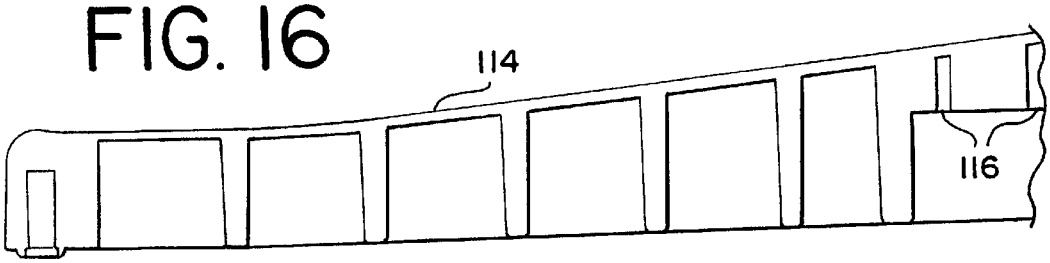
FIG. 16 shows a cross-sectional view of the leg of FIG. 13 taken along lines 16—16 of FIG. 15.

A tabletop support 92 is attached to the bracket 76. The table top support 92 includes an external cylinder or tube 93 that is made of a durable material such as steel and is cylindrical in shape having a diameter of approximately 2.00 inches and a length of approximately 20.25 inches. The tabletop support 92 may include a gas cylinder 104 by inserting the cylinder 104 within the interior of the cylinder 93 via a bushing 89. The bushing 89 is threaded onto the threaded end 90 of the gas cylinder 104 and then slid into the opening 96 of a bracket 94 so as to locate the gas cylinder 104 within the cylinder 93 relative to the tabletop 64. Attachment between the support 92 and the tabletop 64 is provided by the annular top bracket 94 that is attached near the top of the cylinder 93 of the support 92. As shown in FIGS. 8A–C, the bracket 94 has a center opening 96 that allows the bushing 89 to pass through and the bracket 94 has three holes 98 that are aligned with corresponding holes 100 of the central connector 84. Bolts are inserted into the aligned holes 98 and 100 so as to attach the support 92 to the tabletop 64. Note that the tabletop support 92 may comprise the gas cylinder 104 without the exterior cylinder 93.

Figure 7:
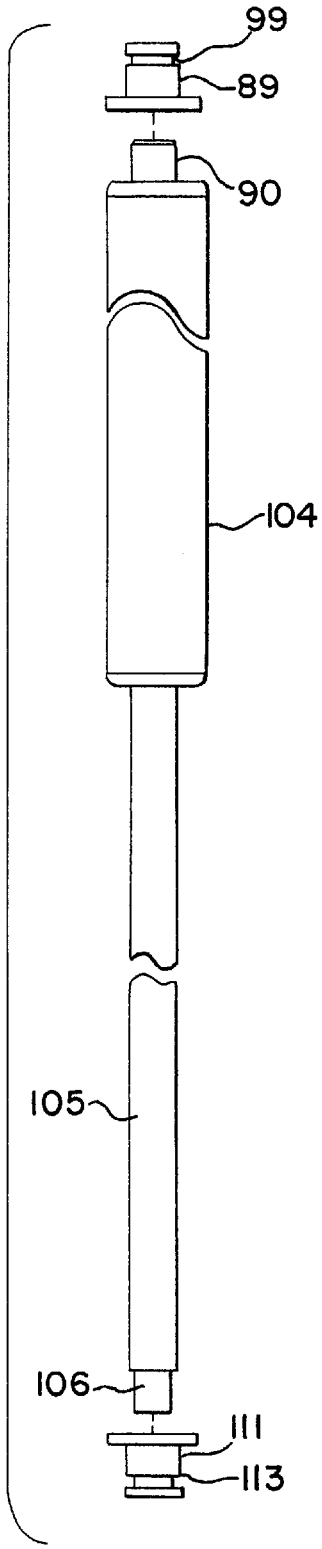
FIG. 7 is a front view of a gas cylinder, a gas spring shaft and bushings for the height adjustable table of FIG. 1.

As shown in FIG. 7, the gas cylinder 104 is substantially cylindrical in shape having a maximum diameter of approximately 0.85 inches and a length of approximately 17.2 inches.

Figure 1:
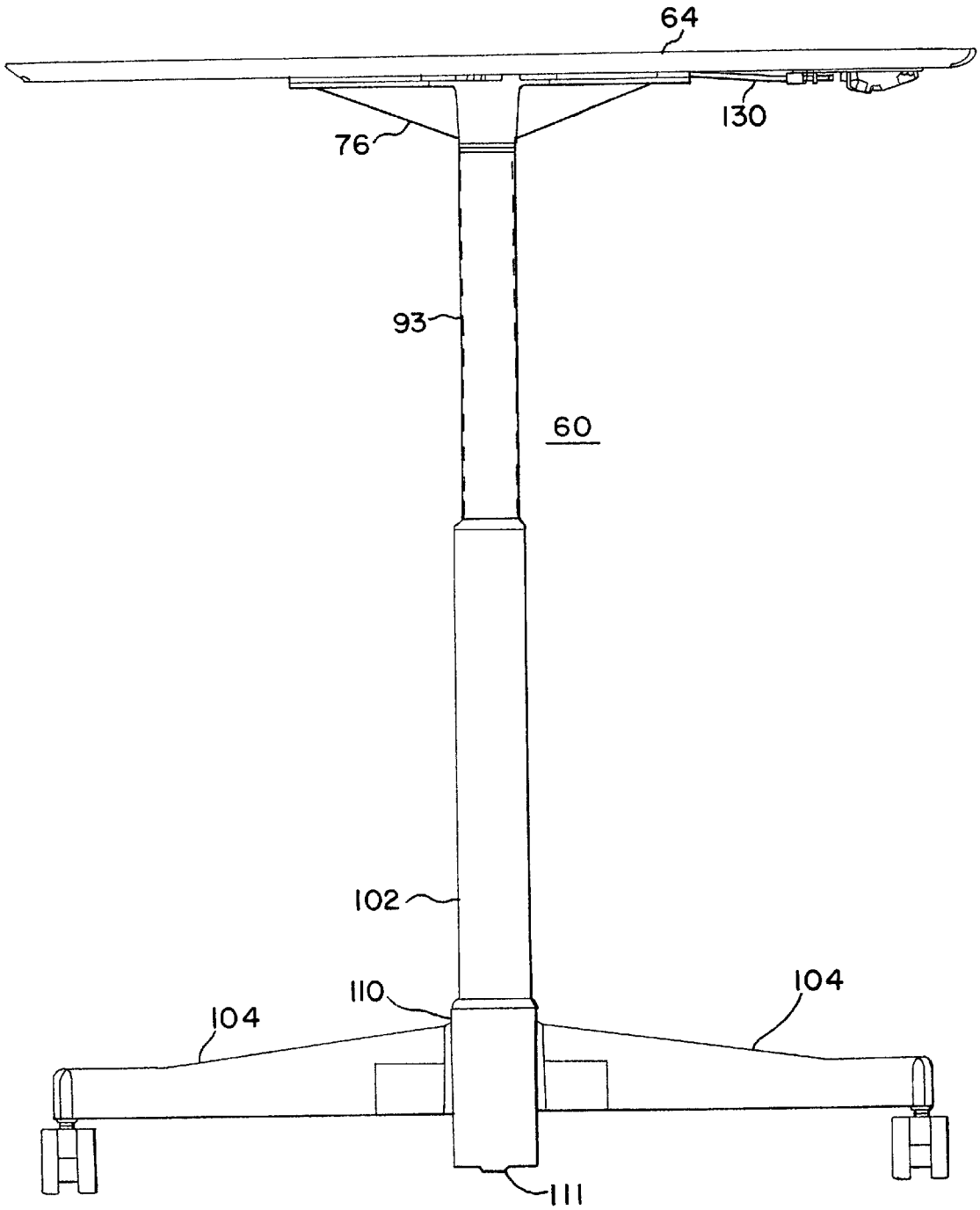
FIG. 1 is a side view of a first embodiment of a height adjustable table according to the present invention.
Figure 21:
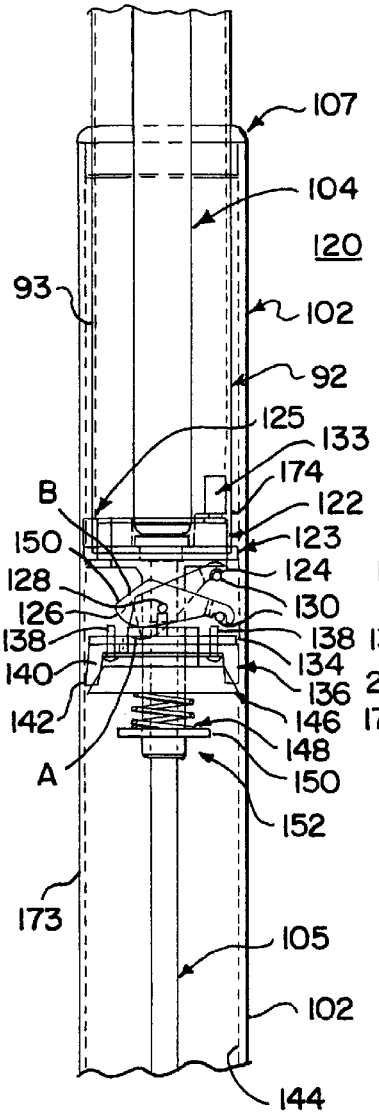
FIG. 21 shows a front view of a first embodiment of a braking mechanism according to the present invention that is to be used with the height adjustable tables of FIGS. 1–20.
Figure 27A:
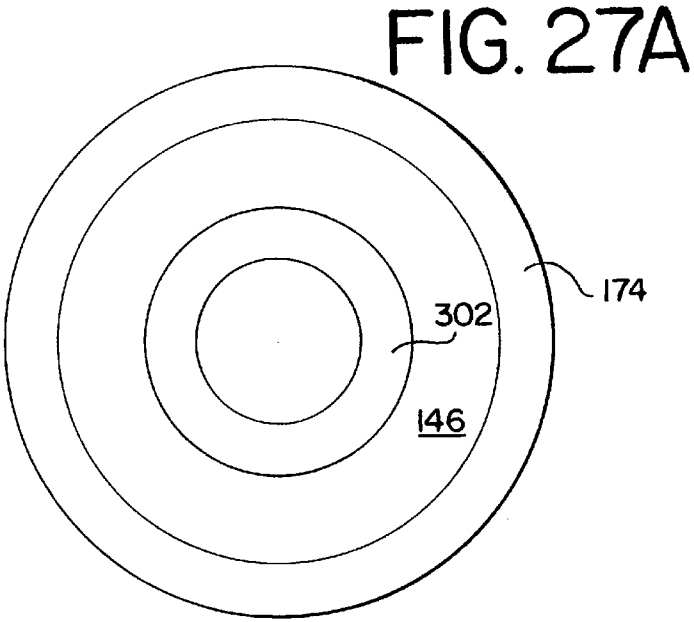
FIG. 27A is a top view of an engagement surface to be used with the braking mechanism of FIG. 21.
Figure 27B:
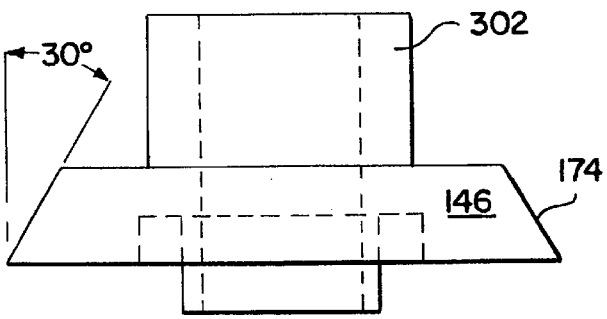
FIG. 27B is a side view of the engagement surface of FIG. 27A.

As shown in FIGS. 1 and 4, a portion of the support 92 is inserted into a cylindrical tube 102. The relative position of the support 92 with respect to the tube 102 is controlled in a well-known manner by the gas spring cylinder 104 and a gas spring shaft 105 that engages the cylinder 104 in a well-known manner. As shown in FIGS. 21 and 27, an annular bearing cap 107 is attached to the top of the tube 102 so as to guide the cylinder 93 of the tabletop support 92. The cylindrical tube 102 has a maximum diameter of approximately 2.50 inches and a length of approximately 23.5 inches. The tube 102 is preferably made of a durable material such as aluminum. The combination of the upper cylinder 93, lower tube 102, gas spring cylinder 104 and gas spring shaft 105 become a telescoping support structure for the tabletop 64.

As shown in FIG. 1, the lower tube 102 forms part of a base 62 for the table 60. The tube 102 is slid into the opening 108 of the die cast hub 110. Three threaded set screws retain the tube 102 to the hub 110 by being threaded through corresponding openings 173 formed in the side of the hub 110. The set screws may engage the lower tube 102 directly or indirectly. For indirect engagement, each set screw has an end that engages a corresponding arcuate clamping surface 175 that radially moves upon an annular ledge 300 formed within the hub 110. In the case of three set screws, each clamping surface subtends an angle of 120 degrees. Rotation of the set screws cause the clamping surfaces 175 to radially move inward and compressively engage the exterior surface of the tube 102. As shown in FIG. 7, the lower end 106 of the shaft 105 is threaded into a bushing 111 that slides into opening 172 of the hub 110 and is retained with a spring clip that engages a groove 113 formed in the bushing 111 that extends exteriorly of the hub 110.

As shown in FIGS. 9–12, the hub 110 is cylindrical-like in shape having a height of approximately 6.0 inches and a diameter of approximately 2.8 inches. The hub 110 is preferably made of aluminum. The hub 110 includes four 3.125 inch long appendages 112. Each of the appendages 112 has a height of approximately 1.8 inches and a width of approximately 0.75 inches. The appendages 112 are separated by 90 degrees from one another.

As shown in FIGS. 1 and 13–16, each appendage 112 is attached to a corresponding leg 114. Each leg 114 is identical in shape having a length of approximately 17.7 inches, a width of approximately 1.4 inches and a maximum height of approximately 3 inches. Attachment of a leg 114 to an appendage 112 is accomplished by placing the leg 114 above the appendage 112 so that the openings 116 of the leg 114 are aligned with the openings 118 of the appendage 112. Bolts (not shown) are inserted through the aligned openings 116 and 118 so as to attach the leg to the appendage. Note that the bottoms of the free ends of the legs 114 may include either levelers that threadedly engage the free ends to level the table top 64 in a well known manner or rollers (not shown) so that the table 60 can be readily moved along a floor.

Figure 17:
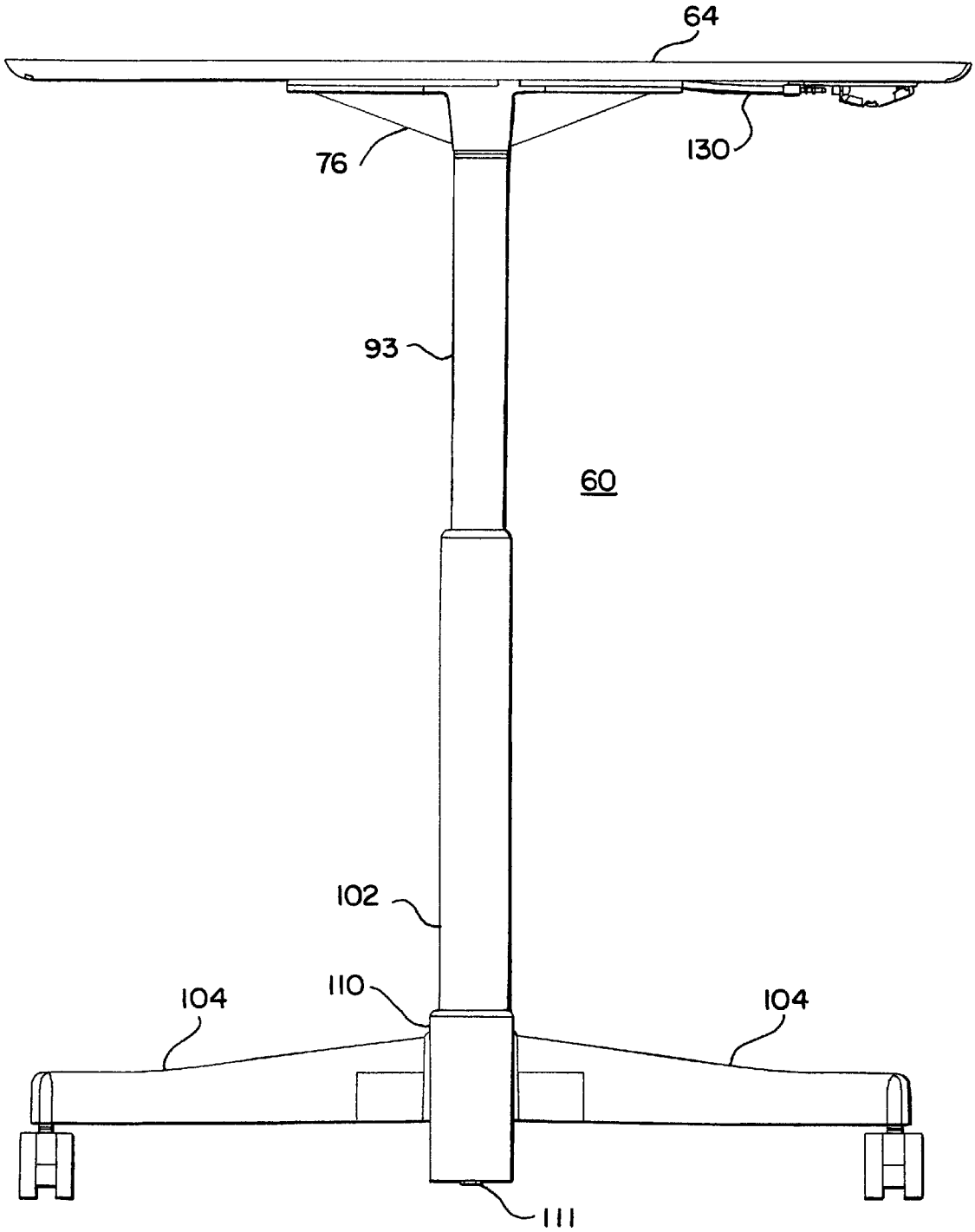
FIG. 17 shows a side view of a second embodiment of a height adjustable table according to the present invention.
Figure 18:
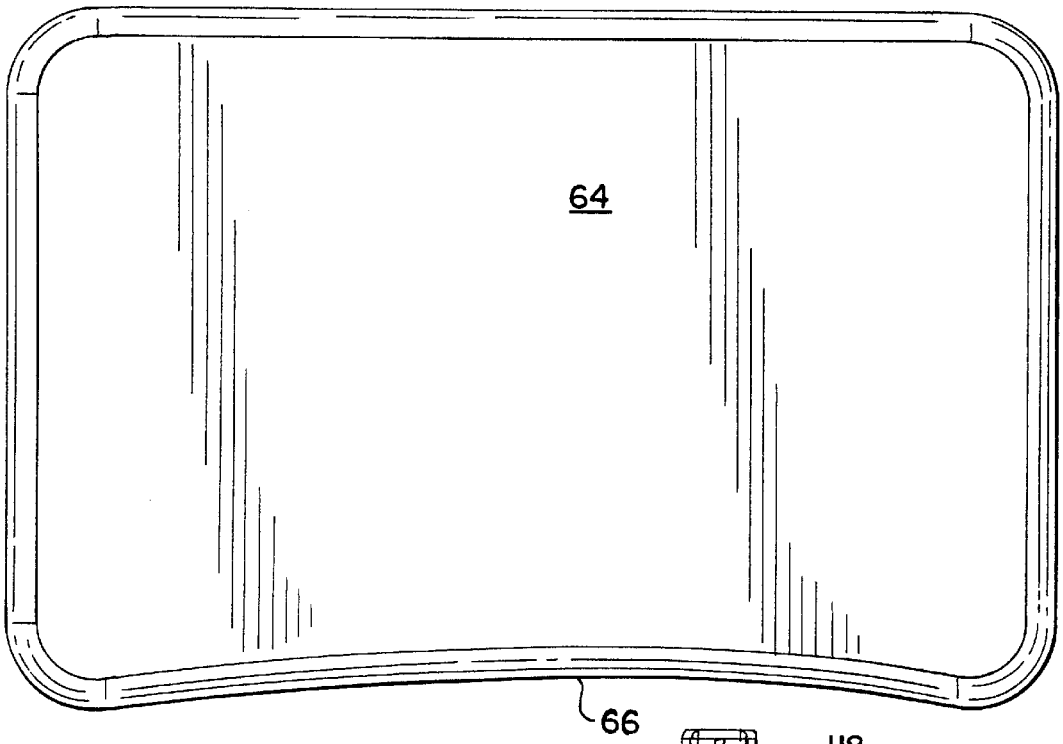
FIG. 18 shows a top view of the height adjustable table of FIG. 17.

Other shapes for the table top 64 are possible. For example, the table top 64 can be substantially rectangular in shape as shown in FIGS. 17 and 18. The table top 64 of FIGS. 17 and 18 has a length of approximately 36.0 inches, a width of approximately 24.0 inches and a thickness of approximately 0.725 inches. A curved indent 66 is formed that extends along a substantial portion of one side of the table top 64 and having a radius of curvature of approximately. As with the table of FIGS. 1–16, the indent 66 identifies the location of the actuator levers below the table top 64. The table top 64 of FIGS. 17 and 18 is preferably constructed in the same manner as the table top 64 of FIGS. 1–16.

The table 60 of FIGS. 17–18 employs a bracket 76, table top support 92, tube 102 that preferably have the same structure and are attached to each other and the rectangular table top 62 as described above with the like numbered parts of the table 60 of FIGS. 1–16. In addition, the tube 102 is attached to the hub 110 via set screws and the lower end of the shaft 106 is attached to the hub 110 via a bushing 111 and spring clip in the same manner as described with the like numbered parts of the table 60 of FIGS. 1–16.

Figure 20:
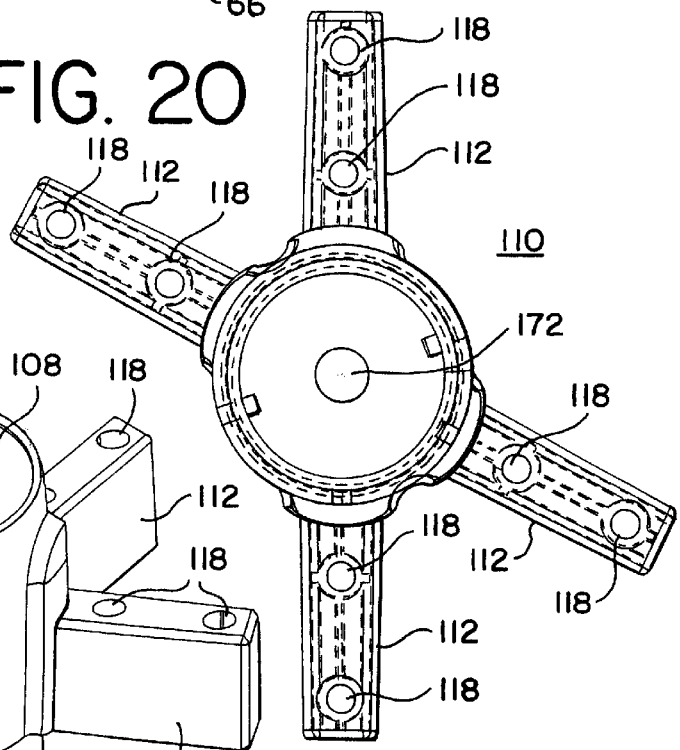
FIG. 20 shows a bottom view of the hub of FIG. 19.
Figure 19:
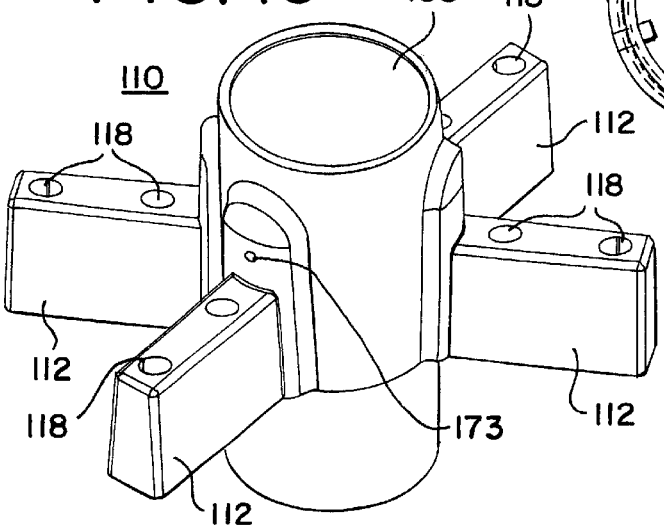
FIG. 19 shows a top perspective view of a hub for the height adjustable table of FIG. 17.

As shown in FIGS. 19–20, the hub 110 is substantially identical to the hub 110 of FIGS. 1–16. The one difference between the hubs is that the appendages 112 of FIGS. 17–20 are separated from one another by angles $\alpha$ and $\beta$ that have values of 62.5 degrees and 117.5 degrees, respectively. Each appendage 112 is attached to a leg 114 that has the same structure as the leg 114 described above for FIGS. 1–16. Attachment of the legs 114 to the appendages 112 is the same attachment scheme as described above between the appendages 112 and legs 114 of FIGS. 1–16.

Figure 22:
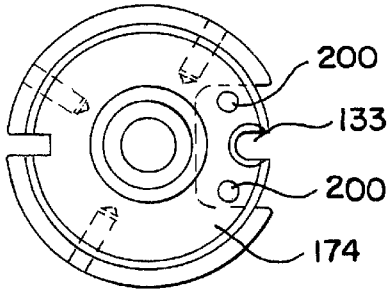
FIG. 22 shows a top view of the braking mechanism of FIG. 21.
Figure 23:
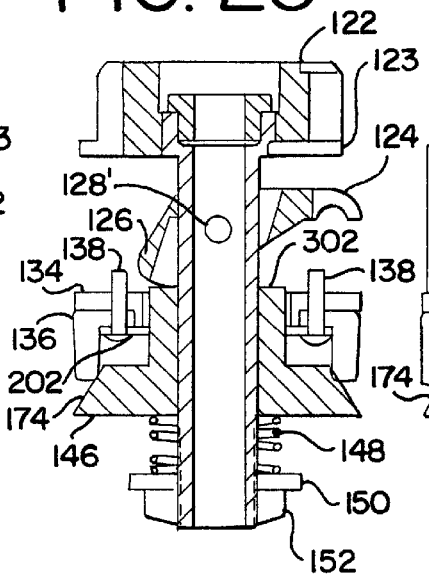
FIG. 23 shows a front view of the braking mechanism of FIG. 21.
Figure 25:
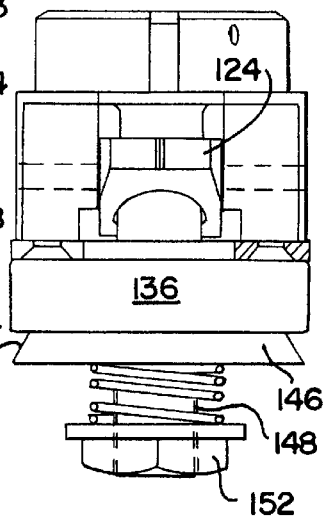
FIG. 25 shows a side view of a top portion of the braking mechanism of FIG. 20.
Figure 24:
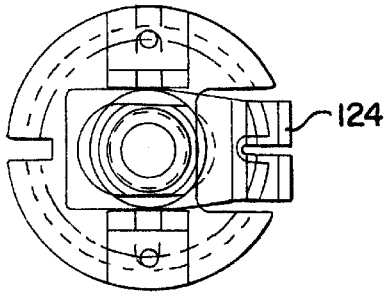
FIG. 24 shows a bottom view of the braking mechanism of FIG. 20.

Each of the tables of FIGS. 1–20 can employ a compression brake mechanism 120, an embodiment of which is shown in FIGS. 21–25. As shown in FIGS. 21 and 23, the brake mechanism 120 forms a part of the table top support 92 by being attached thereto by a brake housing 122 that engages the upper cylinder 93 by using three threaded fasteners through the side wall of the cylinder 93. The brake housing 122 has a Delrin plastic bearing ring 123 that guides the lower end of the cylinder 93 as it moves up and down within the lower tube 102. A Delrin plastic key 125 is attached to the ring 123 so as to prevent relative rotation between the upper cylinder 93 and the outer tube 102 by moving up and down in a groove 173 formed in the lower tube 102.

As shown in FIGS. 21 and 23, the brake housing 122 supports a link 124 that extends downward a distance of approximately one inch. At approximately 0.88 inches from the top of the link 124, a release mechanism, such as the cam surface 126, is present. The cam surface 126 is pivotably attached to the brake housing 122 by inserting a pin through a hole 128 of the brake housing 122 and a hole of the link 124. The cam surface 126 is pivoted by pulling on a cable 130 that is attached to one end of the cam surface 126. The cam surface 126 of the link 124 is normally biased via spring 148 and the top of the cylindrical portion 302 attached to the surface 146 to position B shown in FIGS. 21 and 23. The cable 130 is attached to the brake housing 122 using a molded cylindrical end 133 of the cable 130. As shown in FIG. 22, the cylindrical end 133 is attached by a flat metal bracket 174 and two threaded fasteners. Operation of the cam surface 126 will be described below.

Below the cam surface 126, a compression plate or washer 134 is attached to the brake housing 122 using two threaded fasteners. The plate 134 has a friction element, such as compression ring 136, attached thereto via a plurality of rivets 138 and a retainer washer 202. Since the plate 134 is attached to the brake housing 122, the plate 134 moves with the cylinder 93. The riveting of the compression ring 136 to the plate 134 enables the ring 136 to move up and down with the cylinder 93 also. Thus, the plate 134 and the ring 136 are both incapable of translationally moving relative to the cylinder 93 of the support 92.

Figure 26A:
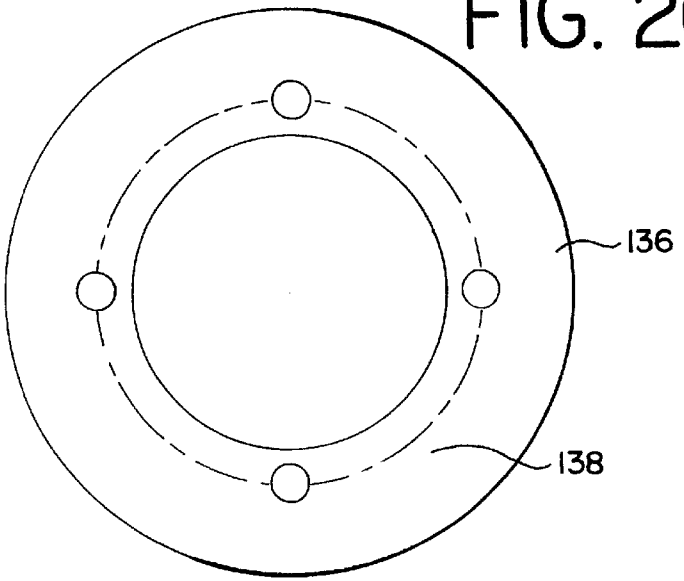
FIG. 26A is a top view of a compression ring to be used with the braking mechanism of FIG. 21.
Figure 26B:
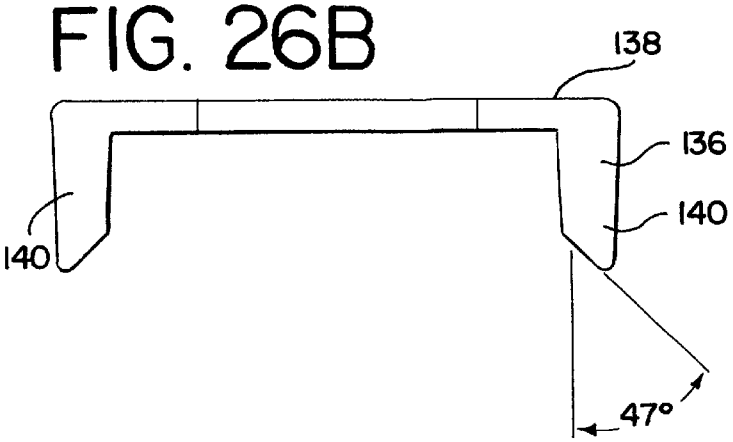
FIG. 26B is a side cross-sectional view of the compression ring of FIG. 26A.

As shown in FIGS. 26A–B, the compression ring 136 has a disk-like base 138 having a diameter of approximately 1.75 inches to which an annular projection 140 is integrally attached thereto. The annular projection 140 extends approximately 0.50 inches from the base 138 and has an outer annular surface 142 that has a diameter of approximately 1.75 inches. The compression ring 136, including the base 138 and the projection 140, are made of a deformable material, such as a moldable Latex.

While the compression ring 136 is prevented from translationally moving as a whole, its projection 140 is movable from a first position where the outer annular surface 142 contacts the inner surface 144 of the tube 102 to a second position where the annular surface 142 is not in contact with the tube 102 of the base 62. The projection 140 is moved to the first position by a biasing mechanism. As shown in FIGS. 21, 23 and 27A–B, an example of a biasing mechanism is the combination of the frustro-conical engagement surface 146 and a compression spring 148 that force the surface 146 to engage the projection 140. The link 124 and its cam surface 126 rest against the top surface of the cylindrical surface 302. The surface 174 and the spring 148 are held in position by a washer 150 and a nut 152 threaded onto the free end 154 of the brake housing 122. The compression of the spring 148 is controlled by rotation of the nut 152. The engagement surface 146 and surface are preferably integral with one another and made of Delrin plastic. The surface 146 has a height of approximately 1.25 inches, a bottom diameter of approximately 1.75 inches and a top diameter of approximately 1.38 inches. The spring 148 preferably is made of music wire, has a diameter of approximately 0.88 inches and has 8 turns per inch.

During engagement, the angled surface 174 wedges itself within the projection 140 which causes the projection 140 to expand radially or outward to an expanded state where the annular surface 142 contacts the inner surface 144 of the tube 102 at the first position. The frictional engagement between the annular surface 142 and the tube 102 is sufficient alone to lock the cylinder 93 of the support 92 so that the table top 64 is prevented to move vertically relative to the base 62.

Unlocking of the table top 64 is accomplished by pulling on the cable 130 with a sufficient force to causes a free end of the link 124 to pivot upward to an engaged position A so as to move the engagement surface 146 downward and compressing the spring 148 and disengaging the surface 174 from the annular surface 142. The downward force generated by the cam surface 126 is sufficient to overcome the upward force generated by the surface 146 and spring 148 to push the engagement surface 146 downward a sufficient distance so that the surface 146 no longer engages the compression ring 136. Nonengagement by the surface 146 causes the compression ring 136 to move to a second position where the annular projection 140 returns to its substantially undeformed state where it no longer contacts the tube 102. When the projection 140 does not contact the tube 102, the table top 64 is free to move relative to the base 62.

The table top 64 is relocked by releasing the cable 130 that causes the link 124 to pivot to a nonengaged position B allowing surfaces 142 and 174 to contact each other. Projection 140 is deformed outward where it engages the tube 102 in the manner described above.

Based on the description above, the height of the table top 64 is adjusted by moving the cam surface 126 to the engaged position A so as to unlock the table top 64 in the manner described above. Once unlocked, the table top 64 is positioned to a desired height relative to a surface or floor 152 supporting the base 62 of the table 60. At the desired height, the table top 64 is locked by releasing the cable 130 and moving the cam surface 126 to the nonengaged position B. As described previously, the cam surface 126 in the nonengaged position causes the table top 64 to be locked solely by frictional engagement of the compression ring 136 with the outer tube 102. The height of the table top 64 is repositioned by ceasing the frictional engagement of the compression ring 136 by pulling the cable 130 and repeating the above steps.

Figure 28A:
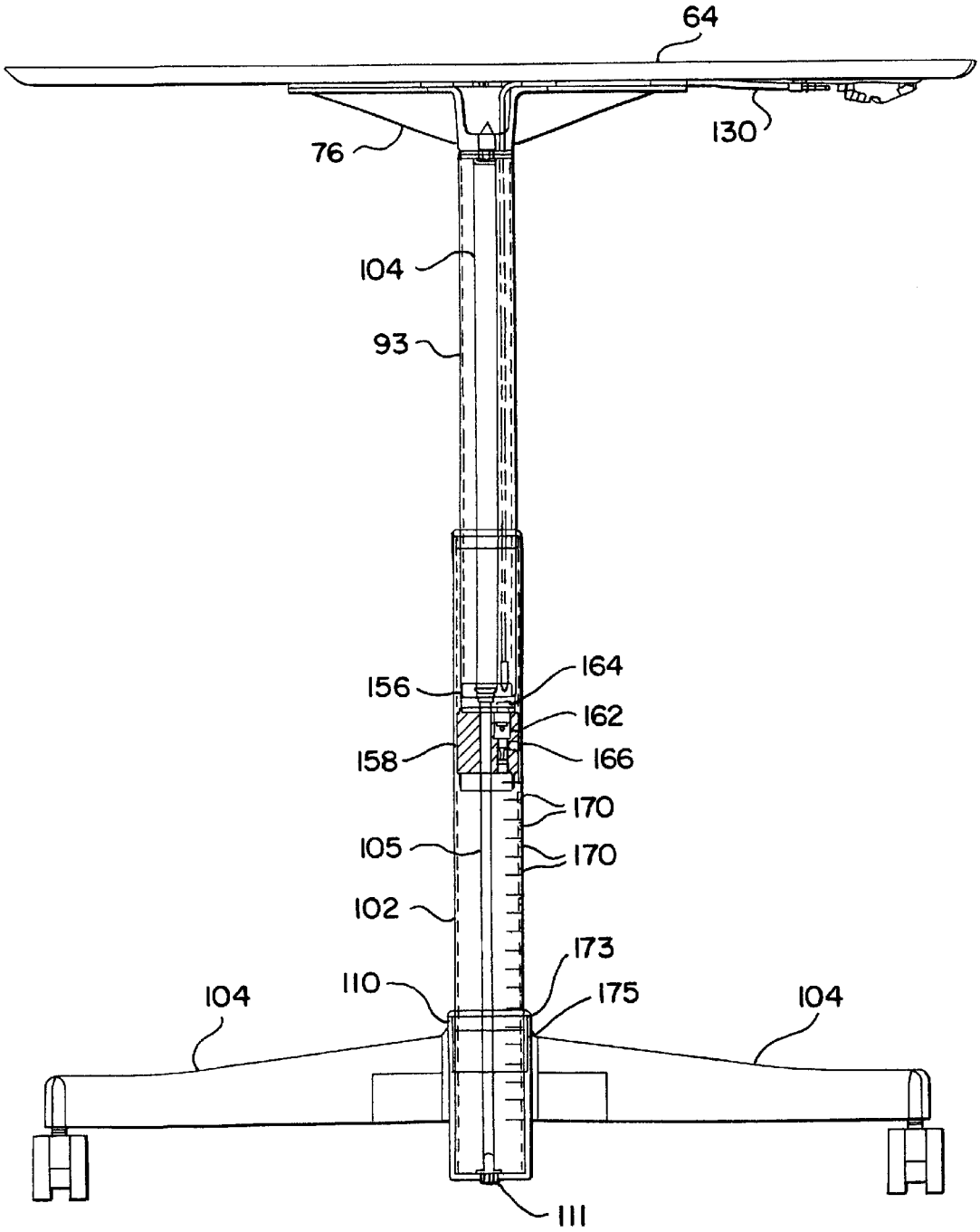
FIG. 28A shows a side cut-away view of a second embodiment of a braking mechanism according to the present invention that is to be used with the height adjustable tables of FIGS. 1–20.
Figure 28B:
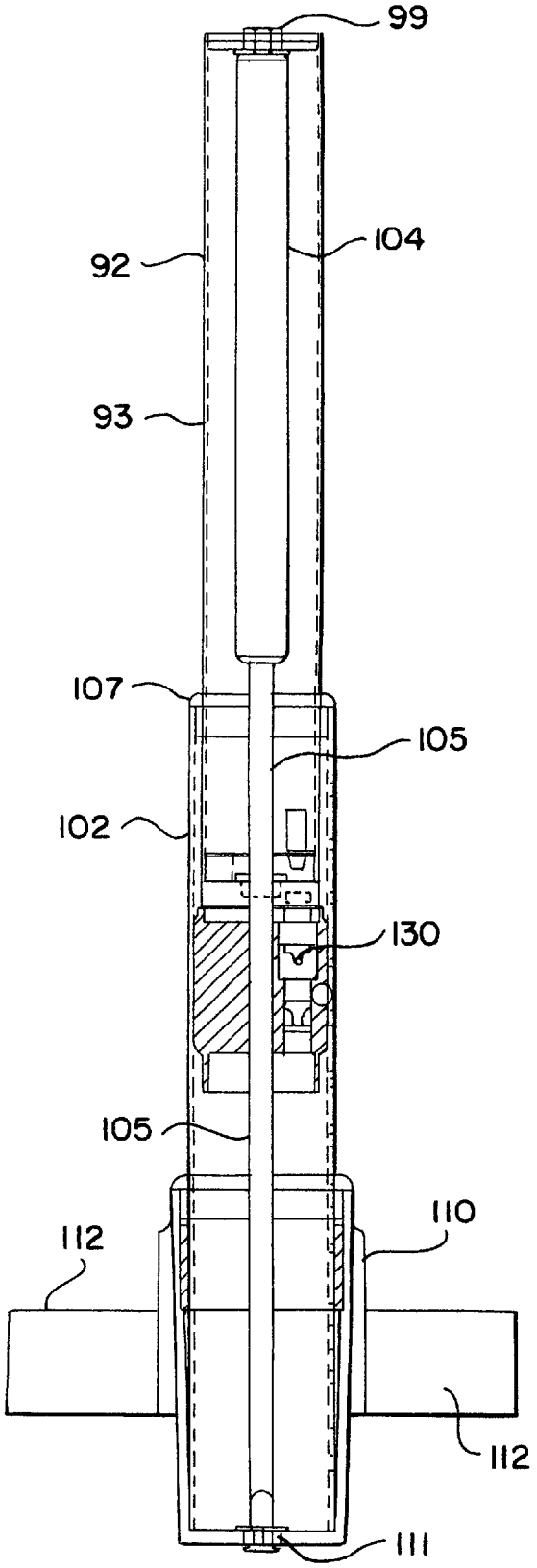
FIG. 28B shows a portion of the cut-away view of FIG. 28A.
Figure 29:
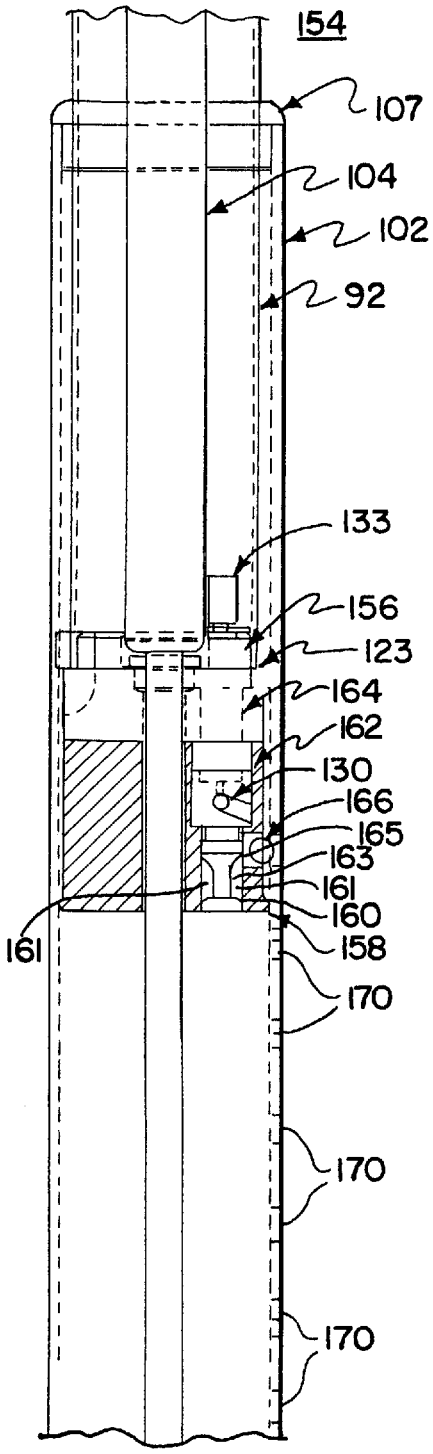
FIG. 29 is front cut-away view of a central portion of the braking mechanism of FIG. 28.
Figure 30:
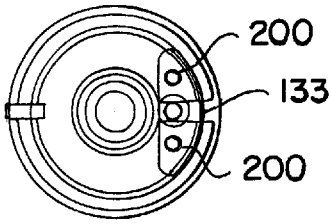
FIG. 30 shows a top view of the braking mechanism of FIG. 28.

Each of the tables of FIGS. 1–20 can employ a ball/plunger brake mechanism 154, an embodiment of which is shown in FIGS. 28–37. As shown in FIGS. 28 and 30, the brake mechanism 154 forms a part of the upper cylinder 93 of the table top support 92 by being attached thereto by an upper brake housing 156 that engages the cylinder 93 by using three threaded fasteners through the side wall of the cylinder 93.

Figure 33:
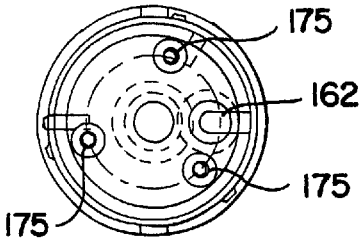
FIG. 33 shows a bottom view of the braking mechanism of FIG. 28.
Figure 37:
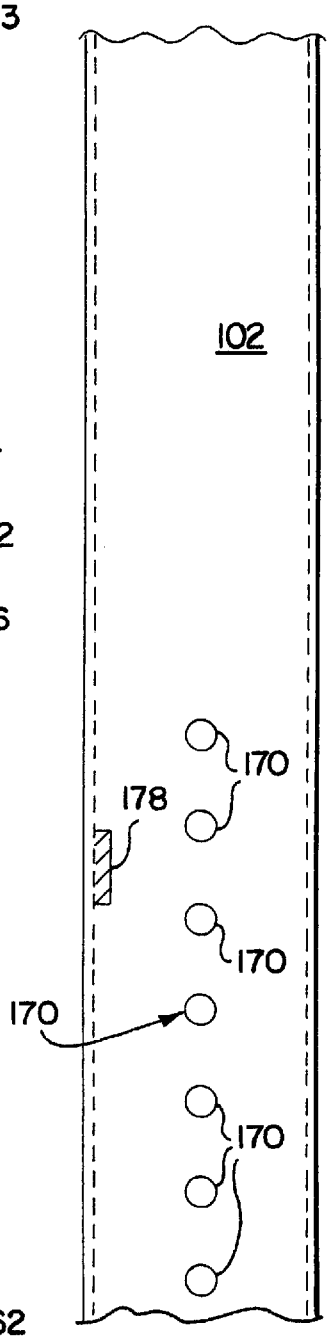
FIG. 37 is a side view of the outer cylinder of the brake mechanism of FIG. 28.
Figure 34A:
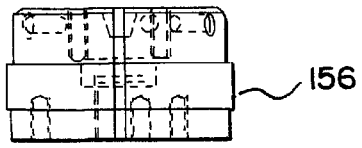
FIG. 34A is a side view of an upper brake housing to be used with the braking mechanism of FIG. 28.
Figure 34B:
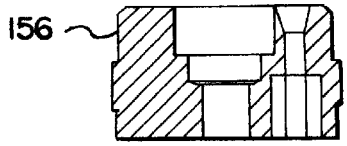
FIG. 34B is a side cross-sectional view of the upper brake housing of FIG. 34A.
Figure 35A:
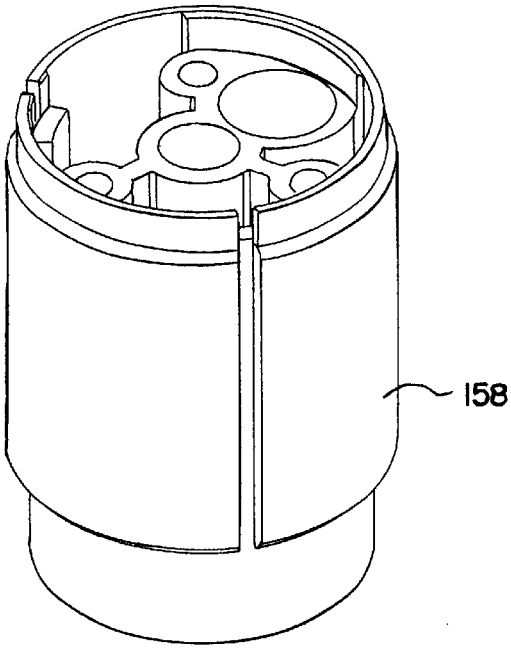
FIG. 35A is a top perspective view of a lower brake housing to be used with the braking mechanism of FIG. 28.
Figure 35B:
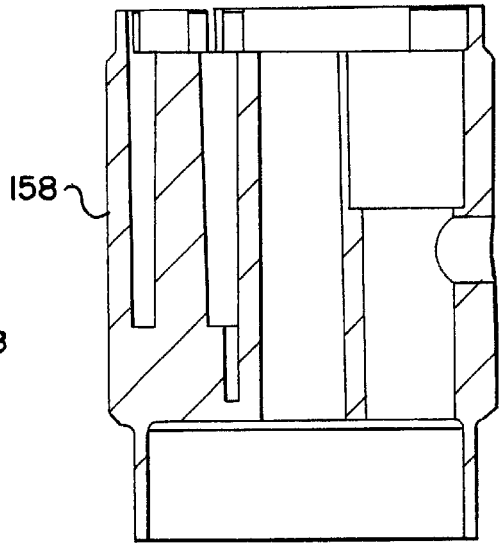
FIG. 35B is a side cross-sectional view of the lower brake housing of FIG. 35A.
Figure 36D:
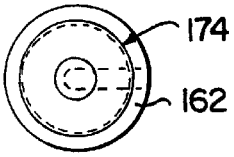
FIG. 36D is a top view of the plunger and trapping mechanism of FIG. 36A.
Figure 36A:
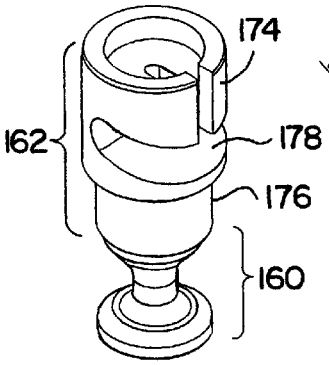
FIG. 36A is a top perspective view of a plunger and trapping mechanism to be used with the braking mechanism of FIG. 28.
Figure 36B:
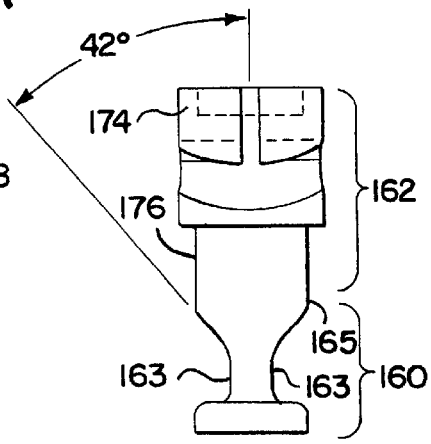
FIG. 36B is a front view of the plunger and trapping mechanism of FIG. 36A.
Figure 36C:
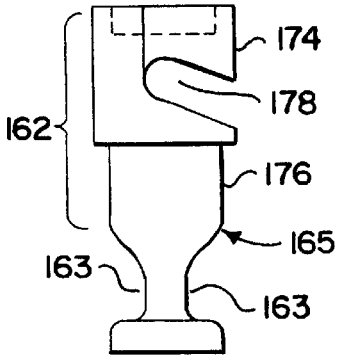
FIG. 36C is a side view of the plunger and trapping mechanism of FIG. 36A.

The upper brake housing 156 (see FIGS. 34A–B) is attached to a lower brake housing 158 (see FIGS. 35A–B) using three threaded fasteners 175 (see FIG. 33). The upper and lower brake housings 156 and 158 house a trapping mechanism 160 that is movable along a vertical direction within a vertical shaft 161 formed in the lower brake housing 158. The top of the trapping mechanism 160 is attached to a plunger 162 that is biased downward by a compression spring 164.

As shown in FIGS. 36A–D, the trapping mechanism 160 preferably has an hour-glass shape with a groove 163 and a contact surface 165. The groove 163 had a maximum depth of approximately 0.156 inches and a cylindrical radius of approximately 0.180 inches. The plunger 162 and the trapping mechanism 160 are integral with one another and are made of a durable material such as steel. The cylindrical surface 176 of plunger 162 is guided vertically by shaft 161 of lower brake housing 158.

Figure 31:
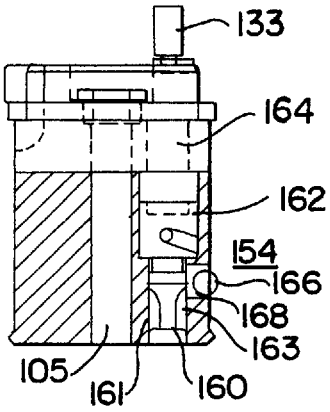
FIG. 31 shows a front view of the braking mechanism of FIG. 28.
Figure 32:
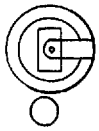
FIG. 32 shows a top view of channel formed in the braking mechanism of FIG. 31.

As shown in FIGS. 29 and 31, the braking mechanism 154 includes an unattached locking element, such as the 0.375 inch diameter metal ball 166, that is selectively trapped or untrapped within the groove 163 of the trapping mechanism 160. The unattached locking element may have other shapes such as a cylinder.

In operation, when the spring 164 biases the plunger 162 downward, the trapping mechanism 160 is moved to a position where the contact surface 165 engages and forces the ball 166 through a circular opening 168 formed in the lower brake housing 158 and partially into one of a plurality of vertically aligned circular openings 170 formed in the outer tube 102. The circular opening 168 as a diameter of approximately 0.385 inches so that the ball 166 can entirely pass through the opening 168 and has a thickness of approximately 0.25 inches so that the ball 166 can fit therein. The circular openings 170 each have a diameter of approximately 0.312 inches so that only a portion of the ball 166 can pass through the opening 170. There are preferably 18 openings 170 that are equally spaced approximately 0.69 inches from one another and are vertically aligned with each other and the opening 168. Note that vertical alignment between the openings 168 and 170 is assured at all times by the vertical slots 177 formed in the lower brake housing 158 and protrusions 178 formed on the inner wall 144 of tube 102. Insertion of the protrusions 178 into the slots 177 prevents relative rotation between the cylinder 93 and the tube 102. Since the contact surface 165 prevents the ball 166 from being removed from both openings 168 and 170, the ball 166 is forced to engage the cylinder 93 and the base 62 simultaneously so as to lock the vertical height of the table top 64 so it is prevented from moving relative to the base 62.

The table top 64 is unlocked by pulling on a cable 130 that is attached within an angled groove 178 of a die-cast cable fitting 174 attached to the plunger 162. The cable 130 is also attached to a molded cylindrical cable end 133 that has the same structure and function as the molded actuator end of the brake mechanism of FIGS. 21–27. Pulling the cable 130 overcomes the downward force of the spring 148 and causes the plunger 162 and trapping mechanism 160 to move vertically upward to an unlocked position where the center of the groove 163 is aligned with the ball 166 that is locked within the openings 168 and 170. Since the groove 163 has a depth sufficient to partially receive the ball 166, the ball moves out of engagement with the opening 170 and moves entirely within the lower brake housing 158. Note that while the ball 166 may contact the inner surface 144 of the tube 102 or an opening 170 as it moves within the opening 168, the ball 166 is incapable of retaining engagement with any of the openings 170 for any significant length of time since the downward force exerted by the top of an engaged opening 170 due to gravity will force the ball 166 to move back into the opening 168 and/or groove 163. Since the ball 166 is incapable of permanently engaging any of the openings 170, the table top 64 and the cylinder 93 of the support 92 can be moved to a desired vertical position relative to the base 62. Note that the above described unlocking can be achieved by a groove 163 that wholly receives the ball 166.

The table top 64 is relocked by releasing the cable 130 and causing the plunger 162 and the trapping mechanism 160 to move downward so as to cause the contact surface 165 to engage the ball 166 and lock the cylinder 93 and the tube 102 in the manner described above.

Based on the description above, the height of the table top 64 is adjusted by pulling on the cable 130 and moving the trapping mechanism 160 to an upper position so as to unlock the table top 64 in the manner described above. Once unlocked, the table top 64 is positioned to a desired height relative to a surface or floor 152 supporting the base 62 of the table 60. At the desired height, the table top 64 is locked by releasing the cable 130 and moving the trapping mechanism 160 to a lower position. As described previously, the trapping mechanism 160 in the lower position causes the table top 64 to be locked by the trapped ball 166 simultaneously engaging the openings 168 and 170 of the lower brake housing 158 and the outer tube 102. The height of the table top 64 is repositioned by ceasing the engagement of the ball 166 by pulling the cable 130 and repeating the above steps.

The foregoing description is provided to illustrate the invention, and is not to be construed as a limitation. Numerous additions, substitutions and other changes can be made to the invention without departing from its scope as set forth in the appended claims.

I claim:

1. A height adjustable table comprising:

a base;

a table top;

a support attached to said table top;

said support selectively engages said base via an unattached locking element so that said table top is prevented from moving relative to said base, wherein said unattached locking element engages simultaneously both a portion of said base and a portion of said support that is positioned within said portion of said base.

2. The height adjustable table of claim 1, wherein said unattached locking element comprises a ball.

3. The height adjustable table of claim 1, wherein said support comprises a brake mechanism that includes a trapping mechanism that moves to a first position where said locking element is forced to engage said support and said base simultaneously.

4. The height adjustable table of claim 3, wherein said trapping mechanism moves to a second position where said locking element is incapable of permanently engaging said base.

5. The height adjustable table of claim 4, wherein said trapping mechanism moves in a vertical direction.

6. The height adjustable table of claim 3, wherein said trapping mechanism moves in a vertical direction.

7. A height adjustable table comprising:

a base;

a table top;

a support attached to said table top, said support selectively engages said base via an unattached locking element so that said table top is prevented from moving relative to said base, wherein said support comprises a brake mechanism that includes a trapping mechanism that moves to a first position where said locking element is forced to engage said support and said base simultaneously and wherein said trapping mechanism has a groove that has a depth sufficient to partially receive said locking element.

8. The height adjustable table of claim 7, wherein said trapping mechanism comprises a contact surface that forces said locking element to engage said support and said base simultaneously.

9. The height adjustable table of claim 8, wherein said trapping mechanism has an hour-glass shape.

10. The height adjustable table of claim 8, wherein said base comprises a first opening;

said support comprising a second opening; and said contact surface forces said locking element to move into and remain within both said first opening and said second opening simultaneously so that relative movement between said support and said base is prevented.

11. The height adjustable table of claim 8, wherein said base comprises a plurality of openings;

said support comprising a second opening; and wherein said contact surface forces said locking element to move into and remain within either one of said plurality of openings of said base and said second opening simultaneously so that relative movement between said support and said base is prevented.

12. The height adjustable table of claim 11, wherein said plurality of openings are spaced from one another along a vertical direction.

13. A height adjustable table comprising:

a base;

a table top;

a support attached to said table top;

said support selectively engages said base via an unattached locking element so that said table top is prevented from moving relative to said base, wherein said support comprises a brake mechanism that includes a trapping mechanism that moves to a first position where said locking element is forced to engage said support and said base simultaneously, wherein said trapping mechanism has a groove that has a depth sufficient to partially receive said locking element and said trapping mechanism moves to a second position where said locking element is incapable of permanently engaging said base.

14. The height adjustable table of claim 13, wherein said trapping mechanism comprises a contact surface that forces said locking element to engage said support and said base simultaneously.

15. The height adjustable table of claim 14, wherein said base comprises a first opening;

said support comprising a second opening; and said contact surface forces said locking element to move into and remain within both said first opening and said second opening simultaneously so that relative movement between said support and said base is prevented.

16. The height adjustable table of claim 14, wherein said base comprises a plurality of openings;

said support comprising a second opening; and wherein said contact surface forces said locking element to move into and remain within either one of said plurality of openings of said base and said second opening simultaneously so that relative movement between said support and said base is prevented.

17. The height adjustable table of claim 16, wherein said plurality of openings are spaced from one another along a vertical direction.

18. The height adjustable table of claim 13, wherein said locking element is partially received within said groove at said second position.

19. The height adjustable table of claim 13, wherein said trapping mechanism is biased to said first position by a spring.

20. The height adjustable table of claim 19, comprising a cable that engages said trapping mechanism where movement of said cable causes said trapping mechanism to move to said second position.

21. The height adjustable table of claim 13, comprising a cable that engages said trapping mechanism where movement of said cable causes said trapping mechanism to move to said second position.

22. A method of locking a height adjustable table comprising:

positioning a table top of a height adjustable table to a desired height along a first direction relative to a surface supporting a base of said table;

moving a locking element along a radial direction with respect to said first direction to a locking position; and locking said table top at said desired height by trapping said locking element at said locking position so as to engage said table top and said base simultaneously.

23. The method of claim 22, wherein said locking element comprises a ball.

24. The method of claim 22, wherein said locking step comprises moving a trapping mechanism to a first position where said locking element is trapped and forced to engage said base.

25. The method of claim 24, further comprising unlocking said locked table top at said desired height by releasing said locking element from said trapped condition.

26. The method of claim 25, wherein said unlocking step comprises moving said trapping mechanism to a second position where said locking element is incapable of permanently engaging said base.

27. The method of claim 26, wherein said trapping mechanism moves in a vertical direction.

28. The method of claim 26, wherein said locking element is partially received within said trapping mechanism at said second position.

29. The method of claim 24, wherein said trapping mechanism moves in a vertical direction.

30. The method of claim 22, further comprising unlocking said locked table top at said desired height by releasing said locking element from said trapped condition.

31. The method of claim 30, wherein said unlocking step comprises moving a trapping mechanism to a position where said locking element is incapable of permanently engaging said base.

32. The method of claim 31, wherein said trapping mechanism moves in a vertical direction.

* * * * *

UNITED STATES PATENT AND TRADEMARK OFFICE

CERTIFICATE OF CORRECTION

PATENT NO. : 6,435,112 B1
DATED : August 20, 2002
INVENTOR(S) : Robert W. Insalaco It is certified that error appears in the above-identified patent and that said Letters Patent is hereby corrected as shown below:

Title page,
Item [73], Assignee, delete "Zerland" and substitute -- Zeeland -- in its place.
Item [56], References Cited, U.S. PATENT DOCUMENTS, delete "Pebreza" and substitute -- Pabreza -- in its place.

Signed and Sealed this

Ninth Day of March, 2004

JON W. DUDAS
*Acting Director of the United States Patent and Trademark Office*